US008262431B2

(12) United States Patent
Nakano et al.

(10) Patent No.: US 8,262,431 B2
(45) Date of Patent: Sep. 11, 2012

(54) TRAVELING TOY SYSTEM

(75) Inventors: Makoto Nakano, Tokyo (JP); Kazuki Takahashi, Tokyo (JP)

(73) Assignee: Konami Digital Entertainment Co., Ltd., Tokyo (JP)

( * ) Notice: Subject to any disclaimer, the term of this patent is extended or adjusted under 35 U.S.C. 154(b) by 68 days.

(21) Appl. No.: 12/601,353

(22) PCT Filed: May 23, 2008

(86) PCT No.: PCT/JP2008/059513

§ 371 (c)(1),
(2), (4) Date: Nov. 23, 2009

(87) PCT Pub. No.: WO2008/146726

PCT Pub. Date: Dec. 4, 2008

(65) Prior Publication Data

US 2010/0173562 A1 Jul. 8, 2010

(30) Foreign Application Priority Data

May 25, 2007 (JP) ..... 2007-139779

(51) Int. Cl.
*A63H 18/00* (2006.01)

(52) U.S. Cl. ..... 446/446; 446/444; 446/135; 446/136; 104/60; 104/61; 238/10 E; 463/61

(58) Field of Classification Search ..... 446/444–447, 446/135, 136, 441; 104/60–61; 238/10 E–10 F; 463/61

See application file for complete search history.

(56) References Cited

U.S. PATENT DOCUMENTS

| | | | | | |
|---|---|---|---|---|---|
| 2,918,284 | A | * | 12/1959 | Baca | 463/67 |
| 3,622,158 | A | * | 11/1971 | Tepper et al. | 463/64 |
| 5,295,889 | A | * | 3/1994 | Ejima | 446/91 |
| 5,320,351 | A | * | 6/1994 | Suzuki | 463/6 |
| 5,382,021 | A | * | 1/1995 | Tatesaka et al. | 463/61 |
| 5,469,036 | A | * | 11/1995 | Eto | 318/581 |
| 5,472,192 | A | * | 12/1995 | Eto | 463/6 |
| 5,601,490 | A | * | 2/1997 | Nakagawa et al. | 463/63 |
| 5,649,863 | A | * | 7/1997 | Wada et al. | 463/62 |
| 5,688,175 | A | * | 11/1997 | Matsuura et al. | 463/61 |
| 5,716,275 | A | * | 2/1998 | Wada et al. | 463/62 |
| 5,741,181 | A | * | 4/1998 | Nakagawa et al. | 463/6 |
| 5,865,661 | A | * | 2/1999 | Cyrus et al. | 446/136 |
| 5,954,584 | A | * | 9/1999 | Yagi | 463/60 |

(Continued)

FOREIGN PATENT DOCUMENTS

JP 07-047171 2/1995

(Continued)

*Primary Examiner* — Gene Kim
*Assistant Examiner* — Matthew B Stanczak
(74) *Attorney, Agent, or Firm* — Rankin, Hill & Clark LLP

(57) ABSTRACT

A traveling toy system is provided, in which it is immediately confirmed where a self-driven towing vehicle is located under an upper track member. Two annular light permeable regions (5B, 5C) are disposed in the upper track member (5). A light emitting means (47) is attached to the self-driven towing vehicle (21). The two light permeable regions (5B, 5C) transmit light emitted from the light emitting means (47) of the self-driven towing vehicle (21). It is recognizable where the light emitting means (47) emits light under the light permeable regions (5B, 5C), as viewed from above the upper track member (5). Thus, it is easy to find where the self-driven towing vehicle (21) is by locating the light-emitting place.

9 Claims, 12 Drawing Sheets

U.S. PATENT DOCUMENTS

| | | | | |
|---|---|---|---|---|
| 5,976,019 | A * | 11/1999 | Ikeda et al. | 463/61 |
| 6,012,957 | A | 1/2000 | Cyrus et al. | |
| 6,095,892 | A | 8/2000 | Moe | |
| 6,394,898 | B1 * | 5/2002 | Nagao et al. | 463/6 |
| 6,840,837 | B2 * | 1/2005 | Kobayashi | 446/136 |
| 6,872,140 | B2 * | 3/2005 | Ishida | 463/58 |
| 7,235,013 | B2 * | 6/2007 | Kobayashi | 463/61 |

FOREIGN PATENT DOCUMENTS

| | | |
|---|---|---|
| JP | 10-071276 | 3/1998 |
| JP | 10-216355 | 8/1998 |
| JP | 2001-178961 | 7/2001 |
| JP | 2004-147838 | 5/2004 |

* cited by examiner

TRAVELING TOY SYSTEM

TECHNICAL FIELD

The present invention relates to a traveling toy system in which a towed object is towed on the top surface of an upper track member by a self-driven towing vehicle running by itself on a lower track member.

BACKGROUND ART

Japanese Patent Application Publication No. 1995-47171 (JP1995-47171A: Patent Document 1) discloses a play toy (traveling toy system) used in a horse racing game, which includes a lower track member, an upper track member disposed above the lower track member with an interval therebetween and having a bottom surface facing the lower track member and a top surface facing the bottom surface in the thickness direction thereof, a carrier (self-driven towing vehicle) provided with a driving source and running by itself on the lower track member, and a moving object (towed object) connected to the carrier (self-driven towing vehicle) by means of magnetic attraction force and running on the top surface of the upper track member. In this conventional play toy, a toy horse fabricated as a dedicated accessory is mounted on the moving object (towed object).

U.S. Pat. No. 6,012,957 (Patent Document 2) discloses a traveling toy system in which a four-wheel toy vehicle running on an upper track member and a self-driven towing vehicle running on a lower track member are connected by means of magnetic force.

U.S. Pat. No. 6,095,892 (Patent Document 3) discloses a traveling toy system in which a two-wheel toy vehicle running on an upper track member and a self-driven towing vehicle running on a lower track member are connected by means of a mechanical connecting means.

Patent Document 1: Japanese Patent Application Publication No. 1995-47171 (JP1995-47171A)
Patent Document 2: U.S. Pat. No. 6,012,957
Patent Document 3: U.S. Pat. No. 6,095,892

SUMMARY OF INVENTION

Technical Problem

When the towed object is towed by means of magnetic force as in the conventional traveling toy systems of Patent Documents 1 and 2, it is difficult to promptly find the presence of the self-driven towing vehicle under the upper track member if the self-driven towing vehicle and the towed object are disconnected. When the mechanical connecting means protrudes through the upper track member as in the conventional traveling toy system of Patent Document 3, the presence of the self-driven towing vehicle can be found at once. Even in this configuration, since a part of the mechanical connecting means is protruding above the upper track member, the self-driven towing vehicle on the lower track member may be displaced if an external force is mistakenly applied to the protruding portion of the mechanical connecting means, which makes it difficult for the self-driven towing vehicle to run. Therefore, it is preferred that a part of the mechanical connecting means do not protrude above the upper track member even when the mechanical connecting means is employed. However, when the mechanical connecting means does not protrude through the upper track member, it is difficult to promptly find the presence position of the self-driven towing vehicle under the upper track member if the self-driven towing vehicle and the towed object are disconnected, as with the conventional traveling toy systems of Patent Documents 1 and 2.

An object of the present invention is to provide a traveling toy system in which the position of the self-driven towing vehicle under the upper track member can be confirmed at once.

Another object of the present invention is to provide a traveling toy system in which the self-driven towing vehicle and the towed object can be connected smoothly.

Solution to Problem

A traveling toy system according to the present invention includes a lower track member, an upper track member, a self-driven towing vehicle and a towed object. The upper track member is disposed above the lower track member with an interval therebetween and has a bottom or rear surface facing the lower track member and a top or front surface facing the bottom surface in the thickness direction thereof. The lower track member and the upper track member may be configured of a single unit component or composed of plural components.

The self-driven towing vehicle is arbitrarily configured and operated. Typically, the self-driven towing vehicle is provided with a driving source and runs by itself on the lower track member. Electric motors are generally used for the driving source of the self-driven towing vehicle. A driving apparatus driving the electric motor may be configured to be operated with a cell as its power source. However, if a current carrying path is disposed on the lower track member, the driving apparatus may be configured to drive the electric motor with electric power supplied from the current carrying path. The operation of the self-driven towing vehicle may be controllable by a controller like a slot car, but the operation thereof may be uncontrollable such that the driving/non-driving is determined only by means of the ON/OFF of a switch. A control method of the operation-controllable self-driven towing vehicle may be the same as that used in the publicly-known slot cars. The towed object running on the upper track member is also configured arbitrarily.

The towed object is magnetically or mechanically connected to the self-driven towing vehicle and runs on the top surface of the upper track member. When the towed object is "magnetically connected" to the self-driven towing vehicle, a magnetic attraction force of a permanent magnet is utilized. Then, the permanent magnet may be fixed onto one of the self-driven towing vehicle and the towed object, and another permanent magnet or some magnetic body may be fixed onto the other of them. The magnitude of the coercive force of the permanent magnet to be used may be appropriately selected according to the thickness of the upper track member. When the towed object is "mechanically connected" to the self-driven towing vehicle, a through-hole is formed in the upper track member to pass through the upper track member in the thickness direction and continuously extending along the upper track member. Then, the self-driven towing vehicle and the towed object are connected via a connecting member passing through the through-hole.

For example, when the towed object and the self-driven towing vehicle are connected by means of a permanent magnet or connected via a mechanical connecting means disposed under the upper track member, it may become hard to know the position of the self-driven towing vehicle if the towed object and the self-driven towing vehicle are disconnected. In the present invention, to solve such a problem, an upper track member may include light permeable regions arranged continuously or at intervals along a running direction of the towed object. The self-driven towing vehicle may include a light emitting means for emitting light recognizable through the light permeable regions as viewed from the top surface of the upper track member. With such configuration, lights emitted from the light emitting means of the self-driven towing vehicle can be confirmed through the light permeable regions even if the towed object and the self-driven towing vehicle are disconnected. As a result, the position of the self-driven towing vehicle can easily be confirmed and the towed object and the self-driven towing vehicle can smoothly be reconnected in a short time.

If the upper track member is made of a light permeable material (for example, if the upper track member is made of a transparent or translucent material), the continuous light permeable region may easily be formed. With such configuration, light emitted from the light emitting means can be confirmed through the upper track member without definitely determining where to attach the light emitting means on the self-driven towing vehicle.

The light permeable regions may be each formed of a through-hole passing through the upper track member in the thickness direction. For example, a slit passing through the upper track member in the thickness direction is formed when mechanical connecting means is used so that lights emitted from the light emitting means may be poured through the slit to the top surface side of the upper track member.

Publicly-known light emitting elements such as a light emitting diode and a lamp may be used as the light emitting means. The light emitting means may emit either a continuous light or a flashing light. The light emitting means emitting a flashing light may draw more attention of viewers.

A driving circuit driving the light emitting means may be configured to cause the light emitting means to always emit light, but more preferably, to cause the light emitting means to emit light only while the self-driven towing vehicle and the towed object are disconnected. Limiting the light emitting period may extend the life of the light emitting element, and help reduce power consumption.

When the light emitting means does not emit light (stops emitting light) while the self-driven towing vehicle and the towed object are connected, it is preferred that the light emitting means be mounted at a position that allows for visual confirmation that the light emitting means does not emit light while the self-driven towing vehicle and the towed object are connected. Such configuration enhances the convenience since completion of the connection may be confirmed by visually confirming that the light emitting means emits no light.

The present invention may also be directed to a track assembly for a toy system to be used for the traveling toy system. The track assembly for a toy system is constituted from the above-mentioned lower track member and the upper track member. The upper track member includes light permeable regions arranged continuously or at intervals along a running direction of the towed object. Preferably, the light permeable regions are so transparent that the presence of the self-driven towing vehicle can be confirmed through the light permeable regions as the upper track member is viewed from the top surface of the upper track member. Thus, the presence of the self-driven towing vehicle may easily be confirmed.

DESCRIPTION OF EMBODIMENTS

Figure 1:
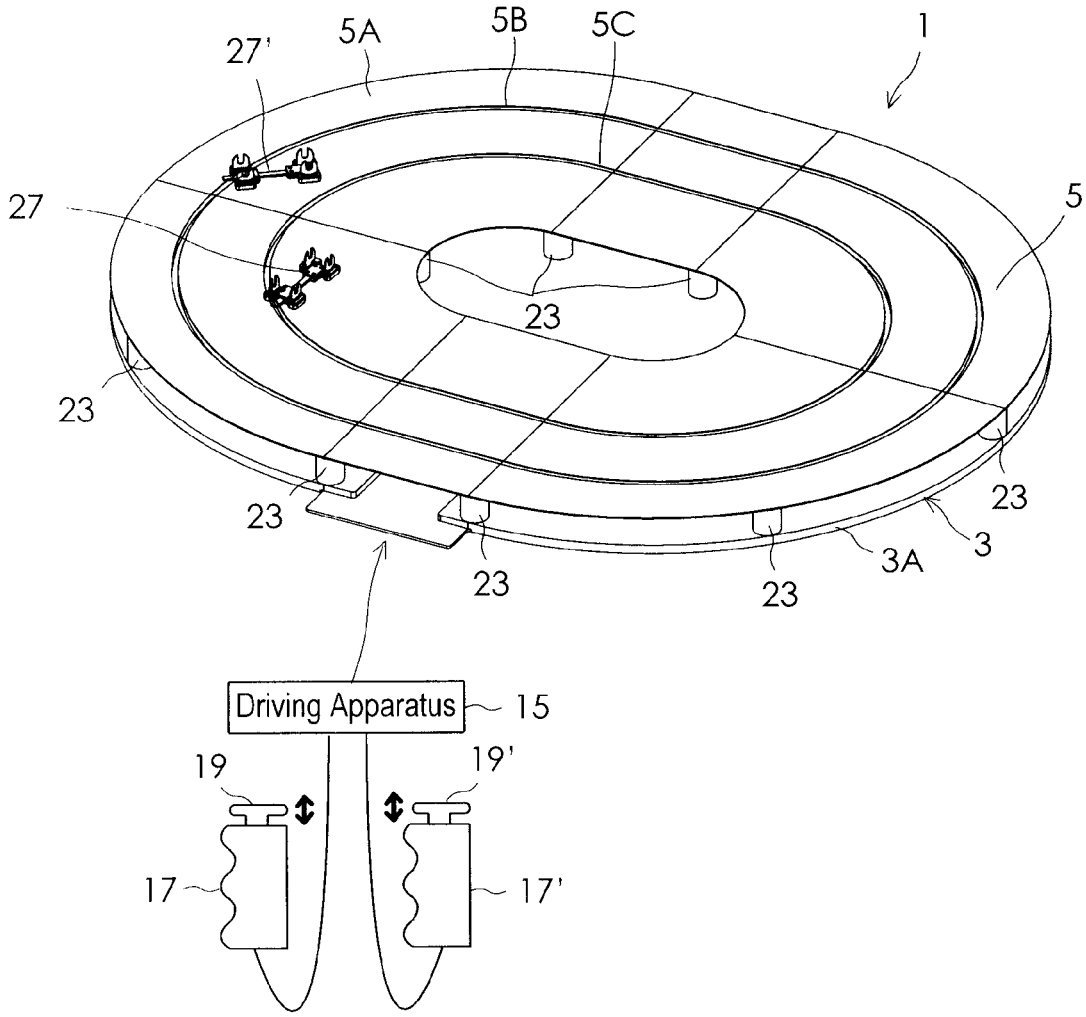
FIG. 1 shows an exemplary configuration of a traveling toy system according to an embodiment of the present invention.
Figure 2:
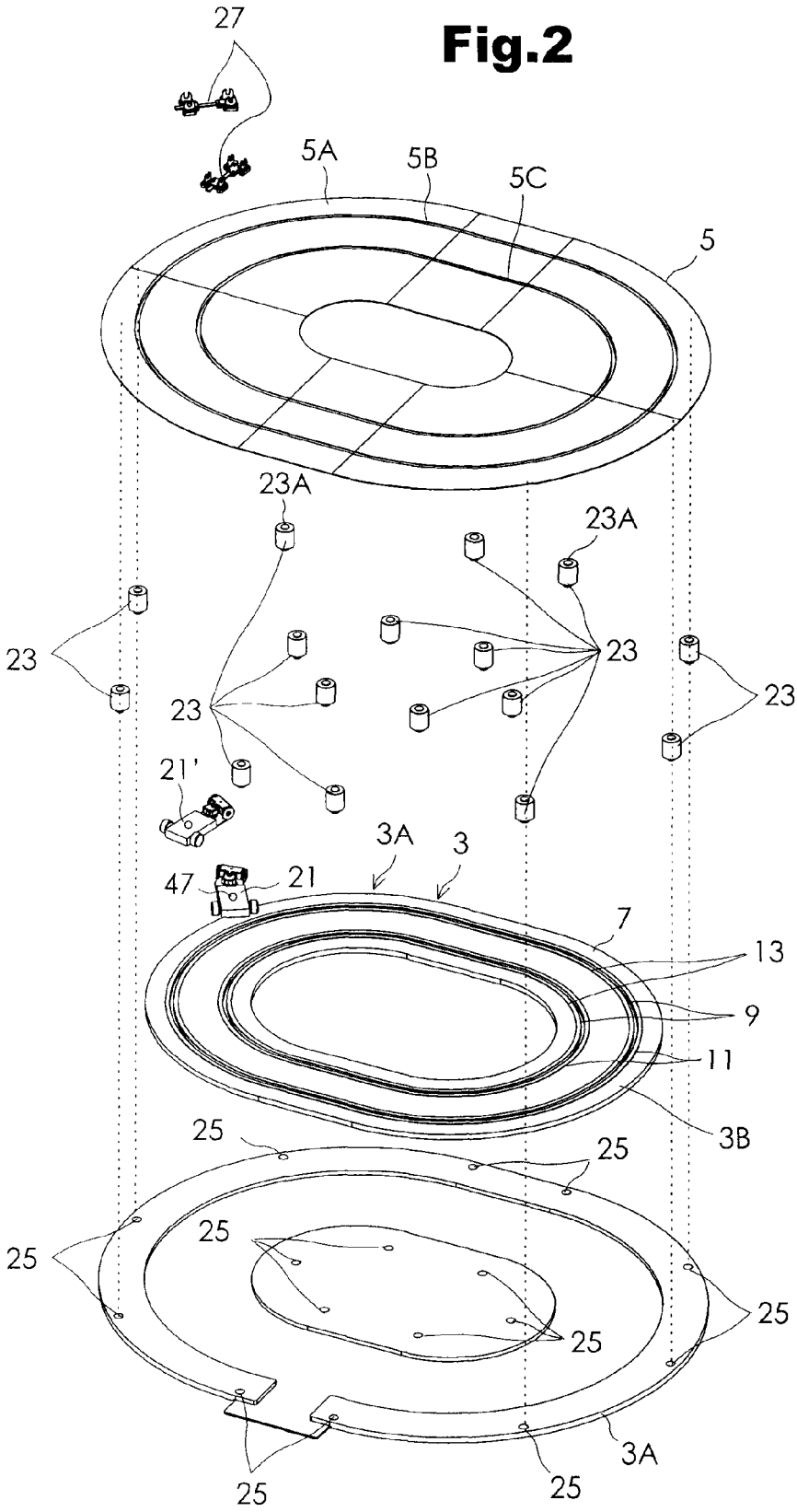
FIG. 2 is an exploded perspective view of a major part of FIG. 1 that is disassembled.
Figure 3:
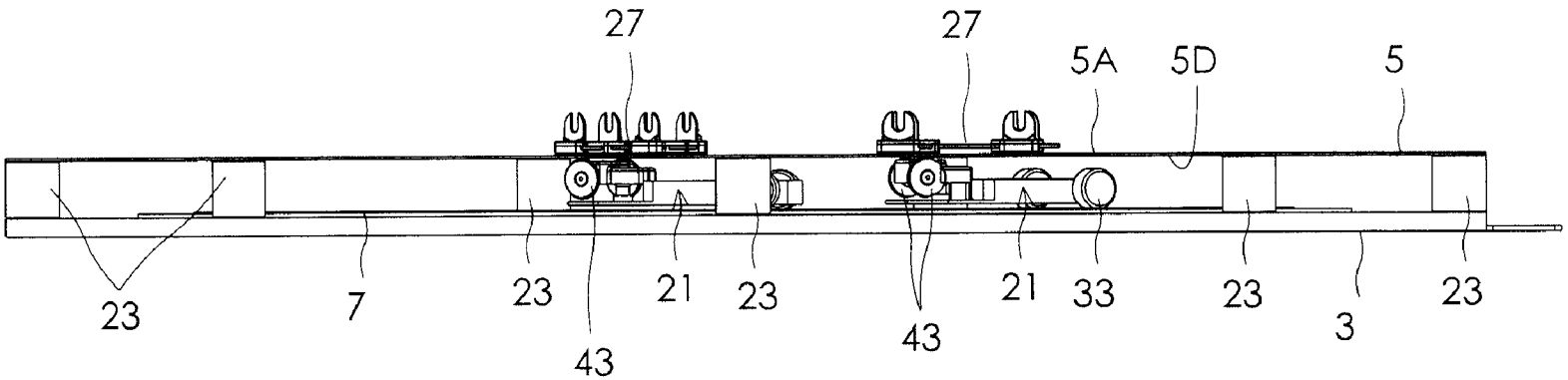
FIG. 3 is an enlarged view of the traveling toy system of FIG. 1 as viewed from the front side thereof.
Figure 4:
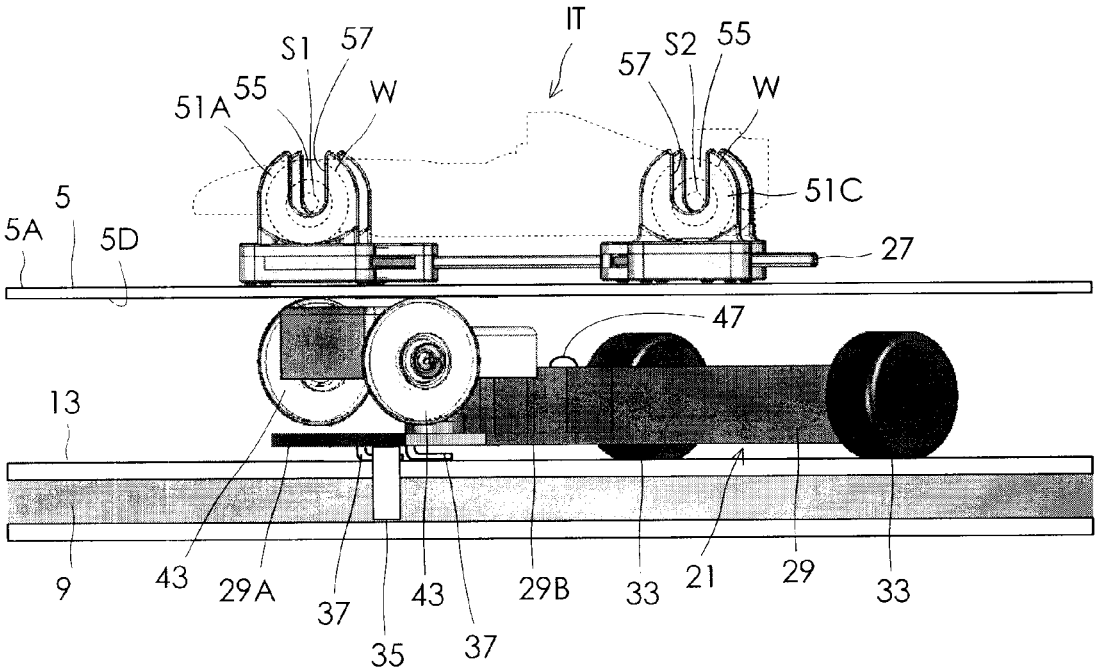
FIG. 4 explains the relationship of a self-driven towing vehicle and a towed object.

Preferred embodiments of a traveling toy system according to the present invention will be described in detail hereinbelow with reference to the drawings. FIG. 1 shows an exemplary configuration of a traveling toy system 1 according to an embodiment of the present invention. FIG. 2 is an exploded perspective view of a major part of FIG. 1 that is disassembled. FIG. 3 is an enlarged view of the traveling toy system of FIG. 1 as viewed from the front side thereof. No imitation toy is mounted on a towed object for easy understanding. In FIG. 4, for easy understanding, a lower track member 3 and an upper track member 5 are illustrated as transparent objects and a four-wheel toy vehicle IT supported on the towed object is illustrated in broken line. In those views, the traveling toy system 1 includes the lower track member 3 and the upper track member 5. As shown in FIG. 2, the lower track member 3 includes a base portion 3A and an annular track portion 3B. The track portion 3B is configured similar to a track of a publicly-known slot car. Namely, the track portion 3B of the lower track member 3 is configured in such a manner that two annular guide slots 9 are formed in an insulating resin plate member 7. Two power-feeding rail members 11 and 13 are disposed on the plate member 7 along the guide slots 9. One of the power-feeding rail members 11 and 13 works as a positive electrode and the other of them works as a negative electrode. DC voltage is applied to these power-feeding rail members 11 and 13 from a driving apparatus 15 of FIG. 1. Illustration of electrical wiring is omitted in FIGS. 1 and 2. As shown in FIG. 1, operations of two self-driven towing vehicles 21 and 21' (hereinafter just referred to as "self-driven towing vehicle 21") are separately controlled by manipulating buttons 19 and 19' (hereinafter just referred to as "button 19") of throttles 17 and 17' (hereinafter just referred to as "throttle 17") manipulated by two players respectively. Operation controlling method of the self-driven towing vehicle 21 is the same as that used for the publicly-known slot cars. For example, the self-driven towing vehicle 21 moves while the corresponding button is held down. The moving speed becomes faster according to an operation amount of the button 19. The self-driven towing vehicle 21 stops its motion when the button 19 is released. The configuration of the self-driven towing vehicle 21 will be hereinbelow described in detail. The self-driven towing vehicle 21 is magnetically connected to towed objects 27 and 27' (hereinafter just referred to as "towed object 27"). The towed object 27 is towed by the self-driven towing vehicle 21 to run on a top surface 5A of the upper track member 5.

Sixteen spacers 23 are disposed between the lower track member 3 and the upper track member 5. These spacers 23 are disposed along the outer edge and inner edge of the base portion 3A of the lower track member 3 at even intervals in the circumferential direction. The spacer 23 integrally has a projection (not illustrated) at its bottom end to fit into a fitting hole 25 formed in the base portion 3A of the lower track member 3. A fitting hole 23A is formed in the top end of the spacer 23. The upper track member 5 integrally has projections (not illustrated) at an outer peripheral portion of the bottom surface of the upper track member 5 to fit into the fitting holes 23A formed in the spacer 23. The upper track member is supported on the lower track member 3 via the spacers 23 with the projections formed on the bottom ends of the spacers 23 being fitted in the fitting holes 25 of the base portion 3A and the projections formed on the bottom surface of the upper track member 5 being fitted in the fitting holes 23A of the spacers 23.

The annular upper track member 5 may be constituted from one plate or may be composed of a plurality of plates. The upper track member 5 includes two annular light permeable regions 5B and 5C. The light permeable regions 5B and 5C may be configured to be transparent or translucent, or may be formed of a through-hole, as long as light can be transmitted. In the present embodiment, the two light permeable regions 5B and 5C are made of a translucent plastic material. The two light permeable regions 5B and 5C transmit light emitted from an after-mentioned light emitting means 47 (FIG. 5), which is constituted from a Light-emitting diode and attached to the after-mentioned self-driven towing vehicle 21. As a result, it is recognizable where the light emitting means 47 emits light under the light permeable regions, as viewed from above the top surface of the upper track member 5. Namely, the position of the self-driven towing vehicle 21 can be found easily by looking for the light emitting position. The material of the plate used to form the upper track member 5 may be arbitrarily chosen. However, it is preferred to use a material having a lower surface friction resistance so that the towed object 27 can smoothly run, sliding on the top surface 5A of the upper track member 5.

According to the present embodiment, each of the two light permeable regions 5B and 5C has a continuous annular configuration, but they may be configured of a plurality of light permeable portions arranged discontinuously. If the plurality of light permeable portions are arranged discontinuously and annularly, the light permeable regions may be constituted from a through-hole so as to simplify the configuration of the light-permeable regions.

According to the present embodiment, even if the towed object 27 and the self-driven towing vehicle 21 are disconnected, the light emitted from the light emitting means 47 of the self-driven towing vehicle 21 may be confirmed through the light permeable regions. Thus the position of the self-driven towing vehicle 21 can be confirmed easily and the towed object 27 and the self-driven towing vehicle 21 can be reconnected in a short time.

Figure 5A:
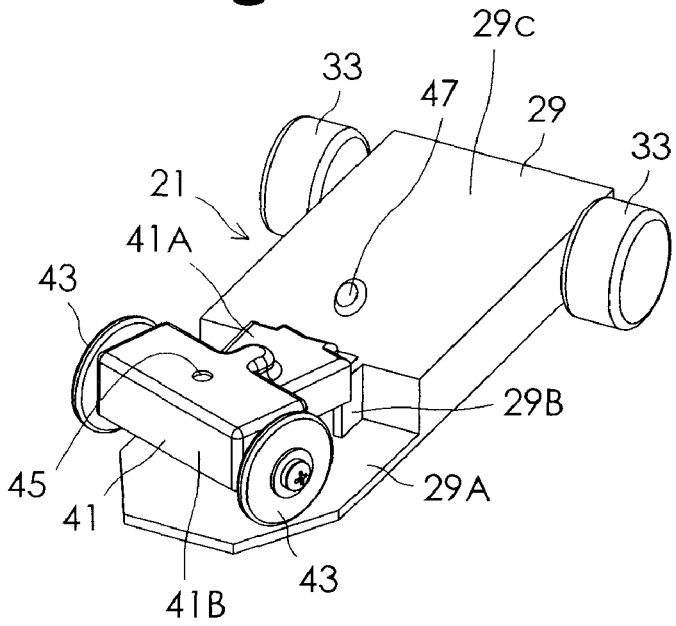
FIG. 5A is a perspective view of the self-driven towing vehicle.
Figure 5B:
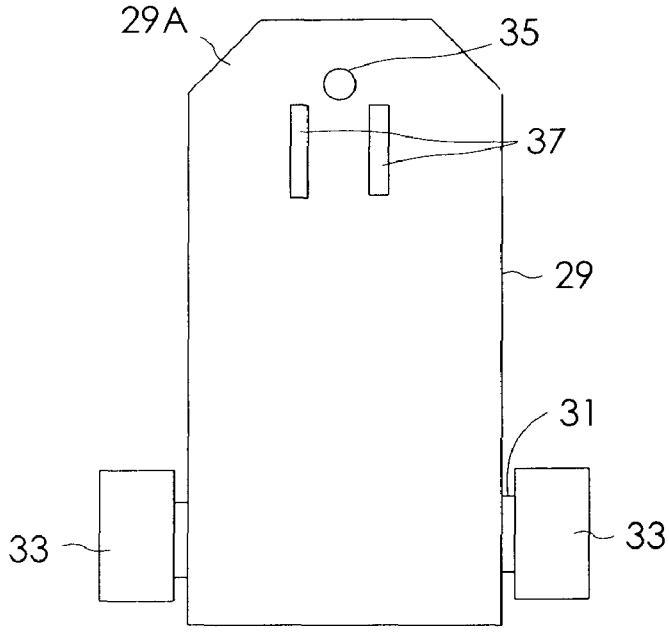
FIG. 5B is a bottom view of the self-driven towing vehicle.
Figure 5C:
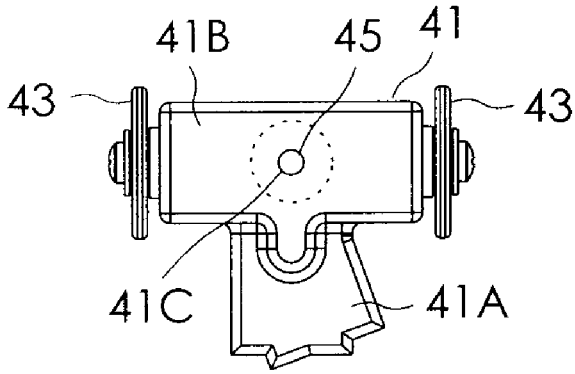
FIG. 5C is a plan view of a component of the self-driven towing vehicle.
Figure 5D:
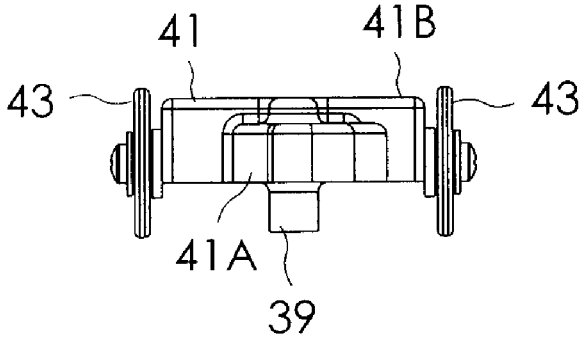
FIG. 5D is a front view of the component of the self-driven towing vehicle.

Subsequent explanation is made on the self-driven towing vehicle 21 to be used in the present embodiment, mainly referring to FIGS. 5A to 5D and also with reference to FIGS. 3 and 4. FIG. 5A is a perspective view of the self-driven towing vehicle 21, and FIG. 5B is a bottom view of the self-driven towing vehicle 21. FIGS. 5C and 5D are a plan view and a front view of a part of the components of the self-driven towing vehicle 21, respectively. The self-driven towing vehicle 21 including a driving source in a vehicle body 29 thereof runs by itself on the lower track member 3. The driving source of the self-driven towing vehicle 21 is an electric motor, not illustrated. According to the present embodiment, a driving apparatus is configured to drive the electric motor with a power supplied from the power-feeding rail members 11 and 13 that are provided on the lower track member 3 as current carrying paths. The self-driven towing vehicle 21 further includes a driving axle 31 which is disposed in the rear of the towing vehicle body 29 as viewed in the traveling direction of the towing vehicle, and driven with the driving source, and a pair of driving wheels 33 that is attached to both ends of the driving axle 31 and rotating on the lower track member 3. A pin member 35, which is fitted into the guide slot 9 shown in FIG. 2, is fixedly disposed on the bottom surface of the towing vehicle body 29 in a position ahead of the driving axle 31, as shown in FIGS. 4 and 5B. In addition, a pair of brush members 37 are disposed on the bottom surface of the towing vehicle body 29 to be in contact with the pair of rail members 11 and 13 to supply power to the driving source. Direct power is supplied through these brush members 37 to the driving apparatus in the towing vehicle body 29.

The towing vehicle body 29 includes a plate-like portion 29A on the front side thereof, and the plate-like portion 29A integrally includes a fitted portion 29B (with reference to FIGS. 5A and 4), into which a turning object 41 that turns about an extended portion 39 (with reference to FIG. 5D) within a given angular range fits. In this embodiment, the extended portion 39 is fixed to the turning object 41. The turning object 41 includes a base portion 41A to which the extended portion 39 is fixed and a body portion 41B to which an after-mentioned permanent magnet is fixed. A pair of roller members 43 are rotatably supported by the body portion 41B of the turning object 41. The pair of roller members 43 are in contact with a bottom surface 5D of the upper track member 5. Although the pair of roller members 43 are provided in this embodiment, only a single roller member may be provided like a front wheel of a three-wheel vehicle. A permanent magnet 45 is fixedly disposed within the body portion 41B of the turning object 41 between the pair of roller members 43. The permanent magnet 45 works to generate a magnetic attraction force between a magnetic object disposed to the towed object 27, which will be described in detail hereinbelow, to magnetically connect the self-driven towing vehicle 21 and the towed object 27. A through-hole 41C is formed in the body portion 41B in a position corresponding to the central portion of the permanent magnet 45 not to weaken the magnetic attraction force. If the pair of roller members 43 are employed, the roller members 43 are rotatably in contact with the bottom surface 5D of the upper track member 5 when the turning object 41 is attracted upward to the side of the bottom surface 5D of the upper track member 5 by the magnetic attraction force of the permanent magnet 45. As a result, the permanent magnet 45 may be prevented from being in contact with the bottom surface 5D even if a permanent magnet having high coercive force is used as the permanent magnet 45.

Figure 6:
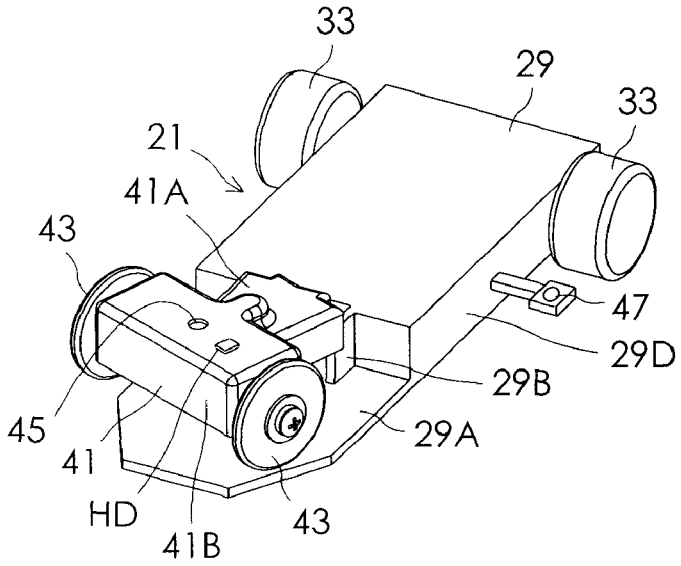
FIG. 6 is a perspective view of a variation of the self-driven towing vehicle.
Figure 7:
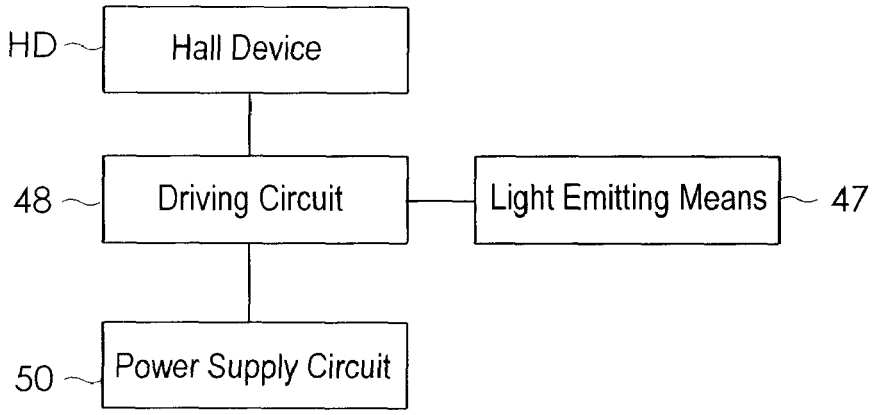
FIG. 7 is a block diagram showing a function of driving a light emitting means.

If the towed object 27 and the self-driven towing vehicle 21 are connected by means of a permanent magnet, it may become hard to know the position of the self-driven towing vehicle 21 at the time that the connection therebetween is broken. In the present embodiment, to cope with this situation, the light emitting means 47 formed of a light emitting diode is disposed on a top wall portion 29C of the towing vehicle body 29 of the self-driven towing vehicle 21 to emit light toward the upper track member 5. The light emitting means 47 may be attached to anywhere as long as the bottom surface of the light permeable regions 5B or 5C provided in the upper track member 5 can be illuminated. For example, as shown in FIG. 6, the light emitting means 47 may be attached to a side face 29D of the towing vehicle body 29. In the example of FIG. 6, the light permeable regions should accordingly be formed at appropriate positions in the upper track member 5. In the example of FIG. 6, the light emitting means 47 is attached to (or the light permeable regions are formed in) a position where the light permeable regions 5B and 5C are not shaded by the towed object 27 in a state where the towed object 27 is placed in an appropriate position. With such configuration, a driving circuit 48 (FIG. 7) of the light emitting means 47 may be configured to cause the light emitting means 47 to emit light only while the self-driven towing vehicle 21 and the towed object 27 is magnetically disconnected, and to stop the light emission of the light emitting means 47 while the self-driven towing vehicle 21 and the towed object 27 are magnetically connected. The turning object 41 is equipped with a Hall device HD to control emission and stoppage of lights from the light emitting means 47 in the example of FIG. 6. The Hall device HD detects magnetic flux of an after-mentioned permanent magnet 75 disposed on the towed object 27. If the Hall device HD does not detect any magnetic flux of the permanent magnet 75 of the towed object 27, the driving circuit 48 shown in FIG. 7 Supplies an electric current from a power supply circuit 50 to the light emitting means 47. When the Hall device HD detects magnetic flux of the permanent magnet 75 of the towed object 27, the driving circuit 48 stops supplying the current to the light emitting means 47. As a result, it may be confirmed whether or not the connection is completed, by visually confirming the stoppage of the light emission of the light emitting means 47 through the light permeable regions 5B or 5C. The light emitting means 47 emits light only while the connection is broken, thereby reducing the light emitting time of the light emitting means 47. This may accordingly extend the life of the light emitting means 47 and reduce power consumption.

Figure 8A:
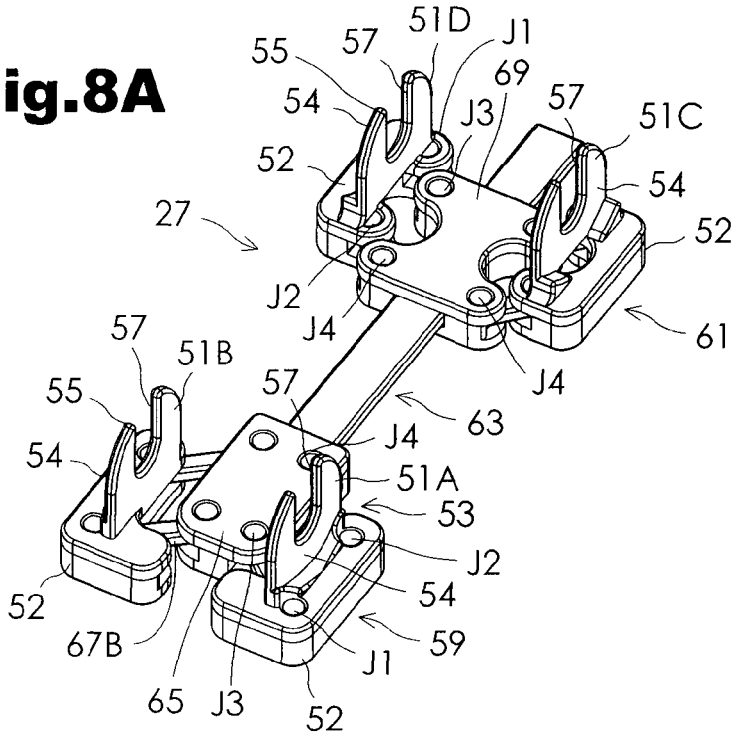
FIGS. 8A and 8B are perspective views of a towed object used in the present embodiment, as viewed from the front side and bottom side thereof.
Figure 8B:
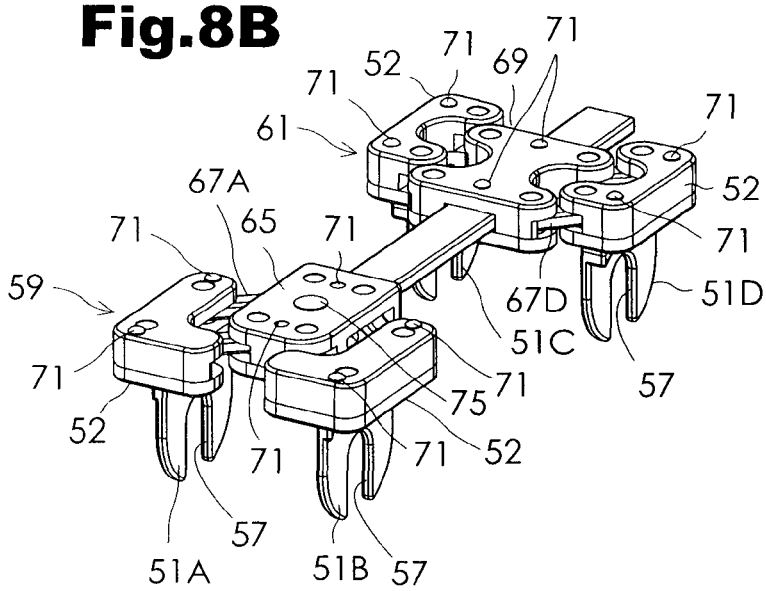
Figure 9A:
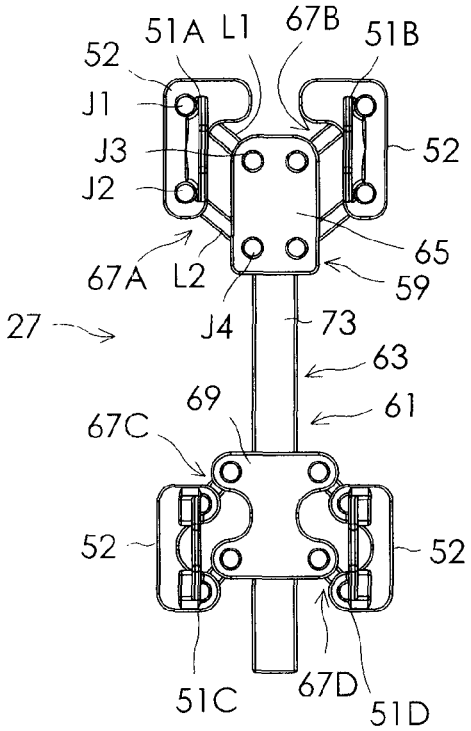
FIGS. 9A to 9C are a plan view, bottom view and a right side view of the towed object, respectively.
Figure 9B:
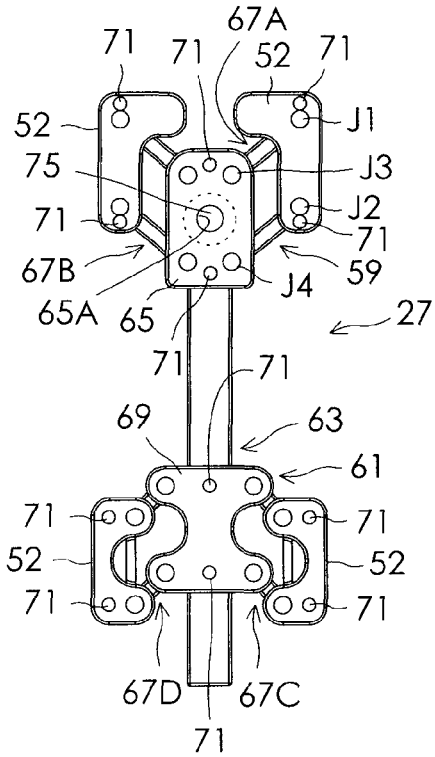
Figure 9C:
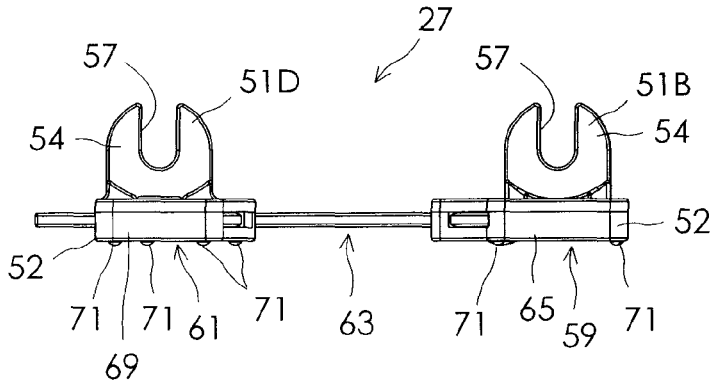
Figure 10A:
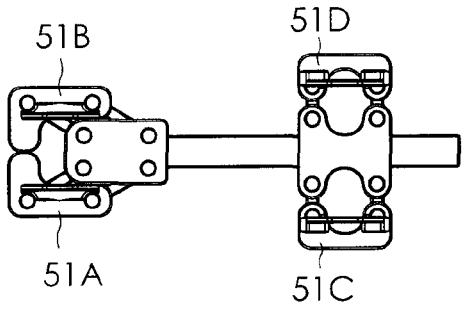
FIGS. 10A to 10E show variations in which the positional relationship of four engaging portions are changed by using four engaging portion supporting mechanisms.
Figure 10B:
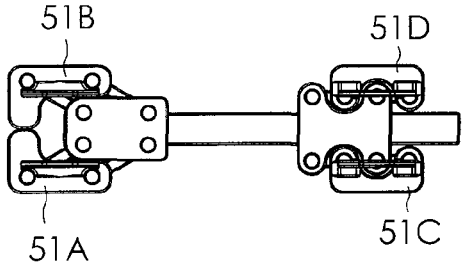
Figure 10C:
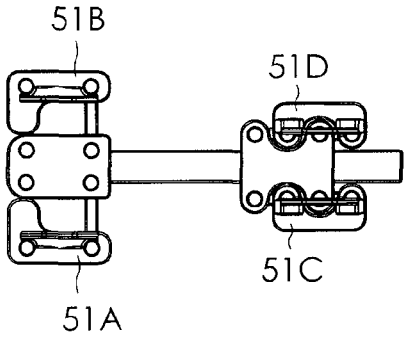
Figure 10D:
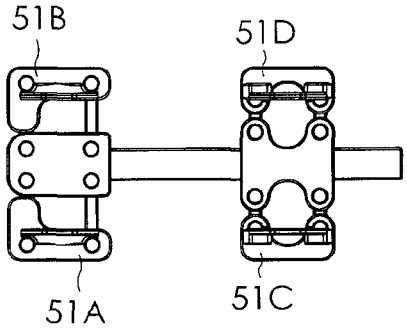
Figure 10E:
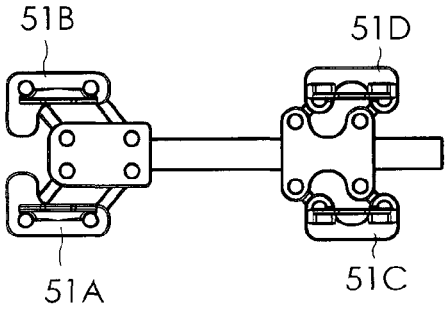

Subsequently, detailed explanation will be made on the towed object 27 that is towed by the self-driven towing vehicle 21 to run on the upper track member 5, with reference to FIGS. 8 to 10. FIGS. 8A and 8B are perspective views of the towed object 27 used in the present embodiment, as viewed from the top and bottom sides thereof, respectively. FIGS. 9A to 9C are a plan view, a bottom view and a right side view of the towed object 27. The towed object 27 includes an attachment 53 having four engaging portions 51A to 51D that partially engage with a commercially-available, not-modified imitation toy (according to the present embodiment, the four-wheel toy vehicle IT of FIG. 4). The attachment 53 is configured so that the positional relationship of the four engaging portions 51A to 51D may be changed according to the dimension of the commercially-available imitation toy IT. The four engaging portions 51A to 51D may be shaped or configured arbitrarily as long as they can support the commercially-available and not-modified imitation toy IT by partially engaging (or fitting) with the imitation toy. In this embodiment, the configuration of the four engaging portions 51A to 51D is determined so that the engagement between a part of the imitation toy and the four engaging portions 51A to 51D may be completed merely by means of a motion of placing the imitation toy upon the attachment 53 or just by putting the imitation toy on the attachment 53.

The commercially-available imitation toy IT applicable to the attachment 53 is a four-wheel toy vehicle in which two wheels W are mounted to two axles S1 and S2 (with reference to FIG. 4) respectively, as depicted with a broken line in FIG. 4. Accordingly, the four engaging portions 51A to 51D of the attachment 53 are configured to engage with the two axles S1 and S2 respectively. The engaging portions 51A to 51D are positioned inside the wheel W that are fixed to the axles S1 and S2, and then engage with the axles S1 and S2. Thus, the imitation toy IT having wheels may be securely mounted on the towed object 27 in an immovable manner. Since the engaging portions 51A to 51D engaging with the axles S1 and S2 are covered by the wheels W, it is less likely that viewers viewing the running towed object 27 are aware of the existence of the towed object 27.

Although the wheels of the four-wheel toy vehicle may be in contact with the top surface 5A of the upper track member 5, there are many imitation toys that cannot change the direction of axles. Accordingly, if the towed object runs with its wheels being in contact with the top surface, the wheels themselves may work as a resistance, thereby making it difficult to perform drifting, for example. In this embodiment, It is preferred that the towed object 27 be configured so that the wheels of the commercially-available imitation toy IT are not in contact with the top surface of the upper track member 5 with the imitation toy being supported by the attachment 53. In the towed object 27, the four engaging portions 51A to 51D engaging with the axles S1 and S2 respectively each include a plate-like portion 54 having a slit portion 57 into which the axles S1 and S2 are fitted, and a base 52 formed integrally with the lower end of the plate-like portion 54 and extending in a direction orthogonal to the plate-like portion 54. The slit portion 57 opens upward and sideward so that the axle S1 or S2 is inserted into an opening portion 55 that opens upward. With such four engaging portions 51A to 51D, the two axles S1 and S2 may be easily engaged with the engaging portions 51A and 51B and the engaging portions 51C and 51D, respectively merely by means of a motion of placing the four-wheel toy vehicle IT on the towed object 27. As a result, the four-wheel toy vehicle IT can be replaced easily with the towed object 27 being placed on the upper track member 5.

The attachment 53 used in the present embodiment is dedicated for supporting a commercially-available four-wheel toy vehicle in which two wheels W are attached to the axle S1 (front axle) and the axle S2 (rear axle) respectively. The attachment 53 is configured so that the positional relationship of the four engaging portions 51A to 513 may be changed according to differences of the tread dimension between the two wheels fixed to both ends of the axle and the wheel-base dimension between two axles.

Specifically, the attachment 53 includes a first structural member 59, a second structural member 61, and an adjustable connecting mechanism 63. The first structural member 59 includes the two engaging portions 51A and 51B engaging with the front axle S1 (FIG. 4) on both end portions thereof adjoining the two wheels W, a first supporting member 65, and two engaging portion supporting mechanisms 67A and 67B that have a function of adjusting the dimension between the two engaging portions 51A and 51B and allow the two engaging portions 51A and 51B to be supported by the first supporting member 65. The second structural member 61 includes the two engaging portions 51C and 51D engaging with the rear axle S2 (FIG. 4) on both end portions thereof adjoining the two wheels W, a second supporting member 69, and two engaging portion supporting mechanisms 67C and 67D that have a function of adjusting the dimension between the two engaging portions 51C and 51D and allow the two engaging portions 51C and 51D to be supported by the second supporting member 69. The adjustable connecting mechanism 63 is configured to connect the first structural member 59 and the second structural member 61, adjusting the distance therebetween. In the attachment 53, dimensions between the two engaging portions 51A and 51B and the two engaging portions 51C and 51D (tread dimensions) are adjustable by means of the adjusting function of the engaging portion supporting mechanisms 67A to 67D. The dimension between the first structural member 59 and the second structural member 61 (wheel-base dimension) is adjustable by means of the adjustable connecting mechanism 63. The engaging portion supporting mechanisms 67A to 67D may be arbitrarily configured. FIGS. 10A to 10E show a plurality of variations to change the positional relationship of the four engaging portions 51A to 51D by using the four engaging portion supporting mechanisms 67A to 67D.

According to the present embodiment, a four-joint parallel link mechanism in which four links are connected via four joints is used as the engaging portion supporting mechanisms 67A to 67D. As a result, the positional adjustment between the pair of engaging portions (adjustment of tread dimension) may easily be performed by means of an operation of sliding the engaging portions 51A and 51B or the engaging portions 51C and 51D along the top surface 5A of the upper track member 5. In the four-joint parallel link mechanism of the present embodiment, as denoted with reference numerals as representatively shown in FIG. 8A and FIG. 9A, a first joint J1 and a second joints J2 of the four-joint parallel link mechanism are provided in the base 52, and a third joint J3 and a fourth joint J4 of the four-joint parallel link mechanism are provided in the supporting members 65 and 69. Since the after-mentioned base 52 is supported by two links L1 and L2, the mechanical strength of the engaging portion supporting mechanisms 67A to 67D may be increased.

In the present embodiment, the bottom surface of the bases 52 and the bottom surfaces of the supporting members 65 and 69 facing the top surface 5A of the upper track member 5 are formed with raised portions 71 to be slidable on the top surface 5A. The raised portions 71 provided on the bottom surfaces of the bases 52 of the four engaging portions 51A to 51D and the raised portions 71 provided on the bottom surfaces of the first and second supporting members 65 and 69 are widely scattered and are in contact with the top surface 5A of the upper track member 5. As a result, the towed object 27 is prevented from being tilted or falling even if the towed object 27 runs on the top surface 5A of the upper track member 5 at a high speed. Since the towed object 27 is supported substantially by means of a point contact with the plural raised portions 71, frictional resistance will not excessively increase. In the present embodiment, the plural raised portions 71 are employed. Compared with those configurations in which a wheel or roller is provided in the towed object 27, the towed object 27 may be less conspicuous.

Figure 11A:
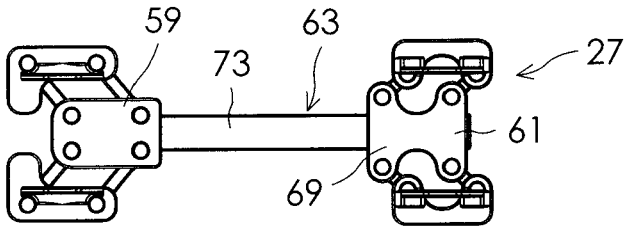
FIGS. 11A to 11C show how an adjustable connecting mechanism is operated.
Figure 11B:
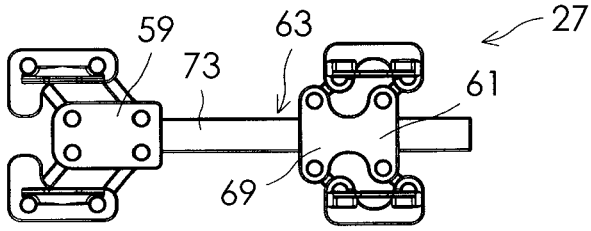
Figure 11C:
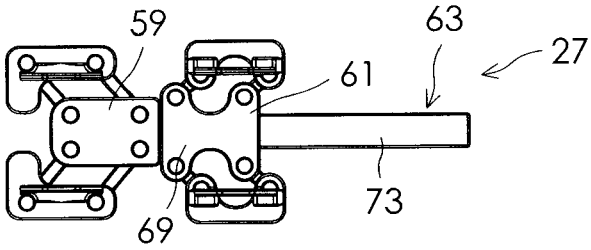

The adjustable connecting mechanism 63 of the attachment 53 includes an elongated frame 73. The first supporting member 65 of the first structural member 59 is fixed to one end of the frame 73 and the second supporting member 69 of the second structural member 61 is slidably attached to the frame 73. With such adjustable connecting mechanism 63 configured in this manner, the dimension (wheel-base dimension) between the first structural member 59 and the second structural member 61 may be adjusted easily by sliding the second supporting member 69 along the frame 73 as shown in FIGS. 11A to 11C. In addition, due to the existence of the frame 73, the mechanical strength may be ensured.

In the present embodiment, the self-driven towing vehicle 21 and the towed object 27 are magnetically connected (by utilizing the magnetic attraction force). As mentioned above, the permanent magnet 45 is fixedly disposed to the self-driven towing vehicle 21 in a position facing the bottom surface 5D of the upper track member 5 (with reference to FIG. 5). As shown in FIGS. 8B and 9B, the permanent magnet 75 attracted by the magnetic attraction force of the permanent magnet 45 is fixedly disposed on the first supporting member 65 of the towed object 27 to face the top surface 5A of the upper track member 5. In this embodiment, the permanent magnet 75 is fixedly embedded in the first supporting member 65. A through-hole 65A is formed in the first supporting member 65 to expose the permanent magnet 75 in order not to weaken the magnetic attraction force. With such configuration, drifting may be performed, in which the rear end portion of the towed object 27 fishtails or swings right and left centering on the front end portion of the towed object 27, because the towed object 27 is towed mainly by the front end portion thereof.

Figure 12:
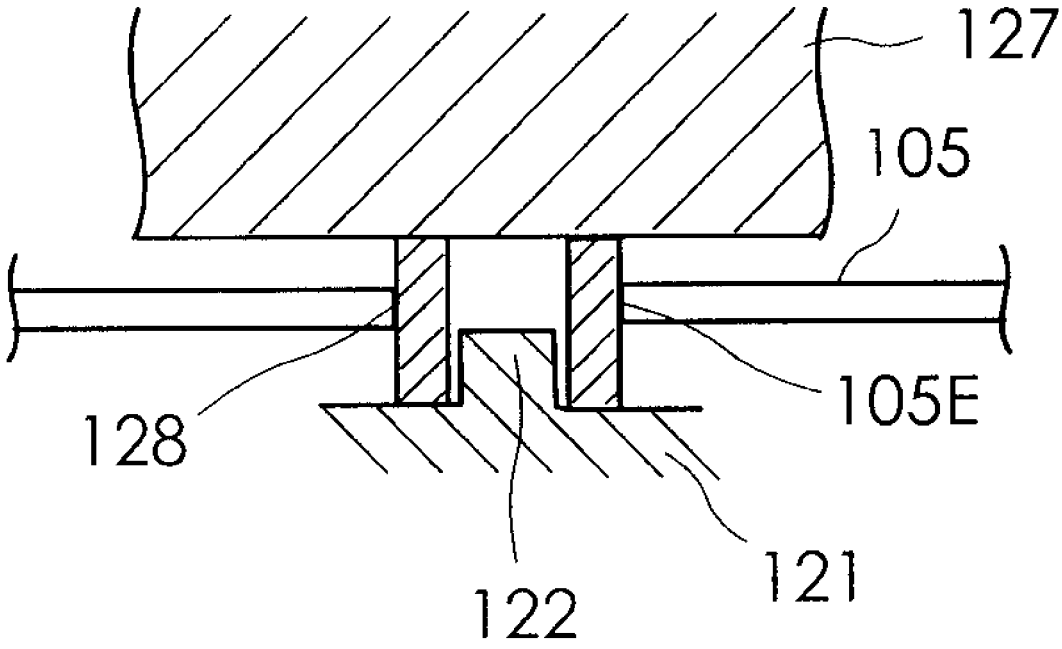
FIG. 12 is a partial sectional view of an exemplary mechanical connecting structure.

In the above-mentioned embodiment, the self-driven towing vehicle 21 and the towed object 27 are magnetically connected. However, if the towed object is mechanically connected to the self-driven towing vehicle, a through-hole 105E is formed to pass through an upper track member 105 in a thickness direction of the upper track member and continuously extend along the upper track member 105 as shown in FIG. 12. Then, a self-driven towing vehicle 121 and a towed object 127 may be coupled via connecting members 122 and 128. In this configuration, the connecting member 122 on the side of the self-driven towing vehicle 121 does not protrude through the through-hole 105E formed in the upper track member 105 toward a side of a top surface 105A thereof. The towed object 127 is configured to include the connecting member 128 that is fitted in the through-hole 105E to be connected to the connecting member 122 as the side of the self-driven towing vehicle 121. Also with this mechanical connecting mechanism, the advantageous effects of the present invention may be obtained.

If the light permeable regions are so transparent that the presence of the self-driven towing vehicle 21 may be confirmed through the light permeable regions 5B and 5C as the upper track member 5 is viewed from above, or if the light permeable regions are formed of through-holes, the self-driven towing vehicle may visually be confirmed even if the light emitting means 47 does not emit light.

INDUSTRIAL APPLICABILITY

According to the present invention, light emitted from the light emitting means of the self-driven towing vehicle may be confirmed through the light permeable regions even if the towed object and the self-driven towing vehicle are disconnected. As a result, the position of the self-driven towing vehicle may be confirmed easily and the towed object and the self-driven towing vehicle may be reconnected smoothly in a short time.

The invention claimed is:

1. A traveling toy system comprising:

a lower track member;

an upper track member disposed above the lower track member with an interval therebetween and having a bottom surface facing the lower track member and a top surface facing the bottom surface in the thickness direction thereof;

a self-driven towing vehicle provided with a driving source and running by itself on the lower track member; and a towed object connected magnetically or mechanically to the self-driven towing vehicle and towed by the self-driven towing vehicle to run on the top surface of the upper track member, the upper track member made of a light permeable material and including light permeable regions arranged continuously or at intervals along a running direction of the towed object;

the self-driven towing vehicle including a light emitting means for emitting light recognizable through the light permeable regions as viewed from the top surface of the upper track member;

the light permeable regions each formed of a through-hole passing through the upper track member in the thickness direction; and the light emitting means emitting flashing light, driven by a driving circuit that causes the light emitting means to emit light while the self-driven towing vehicle and the towed object are disconnected, and mounted on the self-driven towing vehicle at a position that allows for visual confirmation that the light emitting means does not emit light while the self-driven towing vehicle and the towed object are connected.

2. A traveling toy system comprising:

a lower track member;

an upper track member disposed above the lower track member with an interval therebetween and having a bottom surface facing the lower track member and a top surface facing the bottom surface in the thickness direction thereof;

a self-driven towing vehicle provided with a driving source and running by itself on the lower track member; and a towed object connected magnetically or mechanically to the self-driven towing vehicle and towed by the self-driven towing vehicle to run on the top surface of the upper track member, the upper track member including light permeable regions arranged continuously or at intervals along a running direction of the towed object; and the self-driven towing vehicle including a light emitting means for emitting light recognizable through the light permeable regions as viewed from the top surface of the upper track member, wherein the light emitting means is driven by a driving circuit that causes the light emitting means to emit light while the self-driven towing vehicle and the towed object are disconnected.

3. A traveling toy system comprising:

a lower track member;

an upper track member disposed above the lower track member with an interval therebetween and having a bottom surface facing the lower track member and a top surface facing the bottom surface in the thickness direction thereof;

a self-driven towing vehicle provided with a driving source and running by itself on the lower track member; and a towed object connected magnetically or mechanically to the self-driven towing vehicle and towed by the self-driven towing vehicle to run on the top surface of the upper track member, the upper track member including light permeable regions arranged continuously or at intervals along a running direction of the towed object; and the self-driven towing vehicle including a light emitting means for emitting light recognizable through the light permeable regions as viewed from the top surface of the upper track member, wherein the light emitting means is mounted on the self-driven towing vehicle at a position that allows for visual confirmation that the light emitting means does not emit light while the self-driven towing vehicle and the towed object are connected.

4. The traveling toy system according to claim 2, wherein the upper track member is made of a light permeable material.

5. The traveling toy system according to claim 2, wherein the light permeable regions are each formed of a through-hole passing through the upper track member in the thickness direction.

6. The traveling toy system according to claim 2, wherein the light emitting means emits flashing light.

7. The traveling toy system according to claim 3, wherein the upper track member is made of a light permeable material.

8. The traveling toy system according to claim 3, wherein the light permeable regions are each formed of a through-hole passing through the upper track member in the thickness direction.

9. The traveling toy system according to claim 3, wherein the light emitting means emits flashing light.

* * * * *